United States Patent [19]

Kleiner

[11] Patent Number: 4,785,959

[45] Date of Patent: Nov. 22, 1988

[54] COMBINATION CUP AND PLATE HOLDER

[76] Inventor: Charles T. Kleiner, P.O. Box 17879, Anaheim, Calif. 92817

[21] Appl. No.: 111,496

[22] Filed: Oct. 19, 1987

[51] Int. Cl.[4] ..... B65D 21/02

[52] U.S. Cl. ..... 220/23.83; 220/23.86; 220/85 R; 206/562; 206/217

[58] Field of Search ..... 220/85 R, 23.83, 23.86; 206/449, 217, 549, 446, 454, 477, 482, 485, 486, 487, 490, 562, 564, 565

[56] References Cited

U.S. PATENT DOCUMENTS

| | | | |
|---|---|---|---|
| 2,411,864 | 12/1946 | Birkin | 220/23.83 |
| 2,719,414 | 10/1955 | Davis | 220/23.83 |
| 2,916,180 | 12/1959 | Alger | 220/23.86 |
| 3,115,251 | 12/1963 | Farrell | 206/562 |
| 4,607,758 | 8/1986 | Stevens | 206/565 |

*Primary Examiner*—Willis Little

*Attorney, Agent, or Firm*—Morland C. Fischer

[57] ABSTRACT

A combination cup and plate holder to enable a user to easily and convenienty carry, with a single hand, a cup or glass into which a beverage has been poured and a plate upon which food, or the like, has been placed so that the user may keep his second hand free. The cup and plate holder includes a flat platform by which to support the plate and a hollow, cylindrical retaining collar in which to receive the cup or glass. When not in use, the platform is adapted to be rotated towards and received within the collar, whereby to form a compact arrangement that is especially suitable for easy transport and/or efficient storage.

20 Claims, 2 Drawing Sheets

COMBINATION CUP AND PLATE HOLDER

BACKGROUND OF THE INVENTION

1. Field of the Invention

This invention relates to a combination cup and plate holder which may be used at parties or other festive occasions to enable a user to simultaneously carry, with a single hand, a cup or glass that is filled with a beverage and a plate that is filled with food.

2. Prior Art

Individuals who have attended parties or similar events in which food and drink are served are commonly faced with the annoying problem of attempting to simultaneously carry a food-filled plate and a beverage-filled cup or glass. The plate is often carried in one hand of the individual, while the cup is carried in the other hand. However, such a solution is obviously not completely satisfactory, because the user has no free hand by which to eat from the plate or perform other tasks, such as shaking hands with another person, turning on a light switch, writing a note, etc. Consequently, the individual may attempt to carry both the cup and plate in a single hand which may prove to be cumbersome and, thereby, lead to an accidental spilling of the beverage or dropping of the food. Alternatively, the individual may have to lay either the cup or plate on a table in order to obtain the use of a free hand. This action could result in a staining of the table or in the individual forgetting the location or identity of his particular cup or plate.

Accordingly, in an attempt to solve the foregoing problem, devices have been suggested by which a user is able to carry a cup and a plate with a single hand. Examples of such devices are available by referring to one or more of the following U.S. Pat. Nos.

2,413,535: Weidler; Dec. 31, 1946
2,427,697: Weidler; Sept. 23, 1947
3,115,251: Farrell; Dec. 24, 1963
3,542,280: Crabtree; Nov. 24, 1970
4,516,685: French; May 14, 1985
4,607,758: Stevens; Aug. 26, 1986

Unfortunately, these conventional devices are often characterized by relatively large size and weight. Thus, the user's hand may quickly tire of carrying a device which includes the added weight of a beverage and/or food. Moreover, because of the relatively large size thereof, some of the conventional devices may not be suitable for use at the parties when people are crowded closely together. What is more, the volume consumed by the conventional devices correspondingly increases the difficulty and reduces the efficiency of transport and storage. What is still more, the conventional devices do not always adequately retain the food-filled plate thereon. Therefore, a lightweight, compact, easily storable plate and cup holder which will reliably receive and retain a cup and a plate would be preferable over the conventional devices listed above.

SUMMARY OF THE INVENTION

In general terms, a combination cup and plate holder of relatively light weight and small size is disclosed for use at parties, or the like, to enable a user to simultaneously carry, with a single hand, both a cup or glass which has been filled with a beverage and a plate upon which food is placed. The cup and plate holder comprises a flat, tongue-shaped platform to support a plate and a cylindrical retaining collar in which to receive the cup or glass. The platform is connected to a rotatable support block, so that the platform is rotatable therewith. That is to say, the platform may be rotated to either an open position extending forwardly of the retaining collar so as to receive a plate or to a closed position over the top of the retaining collar by which to form a compact arrangement that is especially suitable for transport and/or storage.

An adjustable clamp is detachable connected to the support block and projects outwardly therefrom above the platform. The clamp includes a set of normally closed jaws between which the lip or rim of the plate is received so that the plate can be retained upon the platform. The clamp is slideable through a vertically extending slot formed in the support block. Accordingly, the location of the opposing jaws of the clamp can be selectively adjusted relative to the platform, whereby plates (or bowls) of various configurations and dimensions may be attached between said jaws so as to be reliably supported upon the platform.

DESCRIPTION OF THE PREFERRED EMBODIMENT

Figure 1:
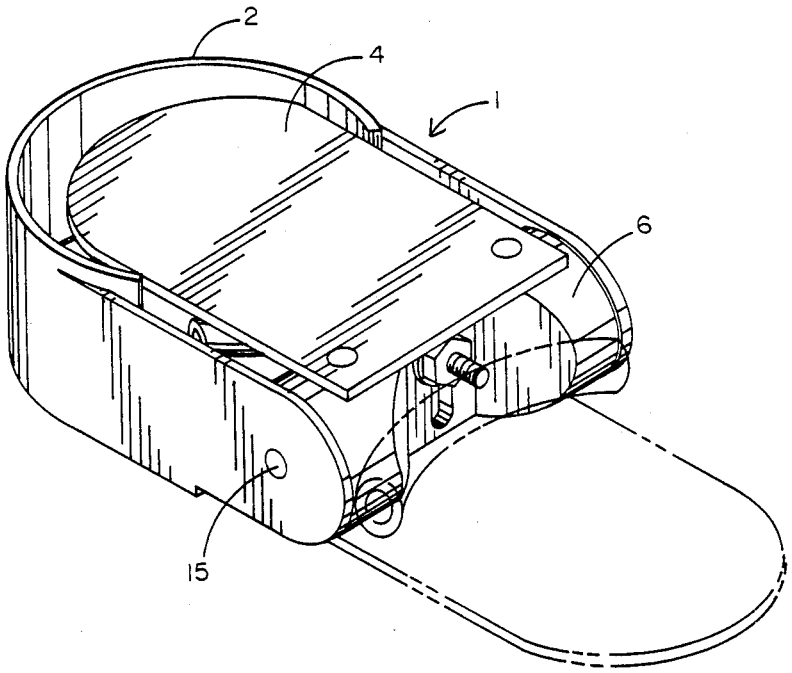
FIG. 1 is an elevational view of the cup and plate holder which forms the present invention with a plate retaining platform rotated to a closed position.
Figure 2:
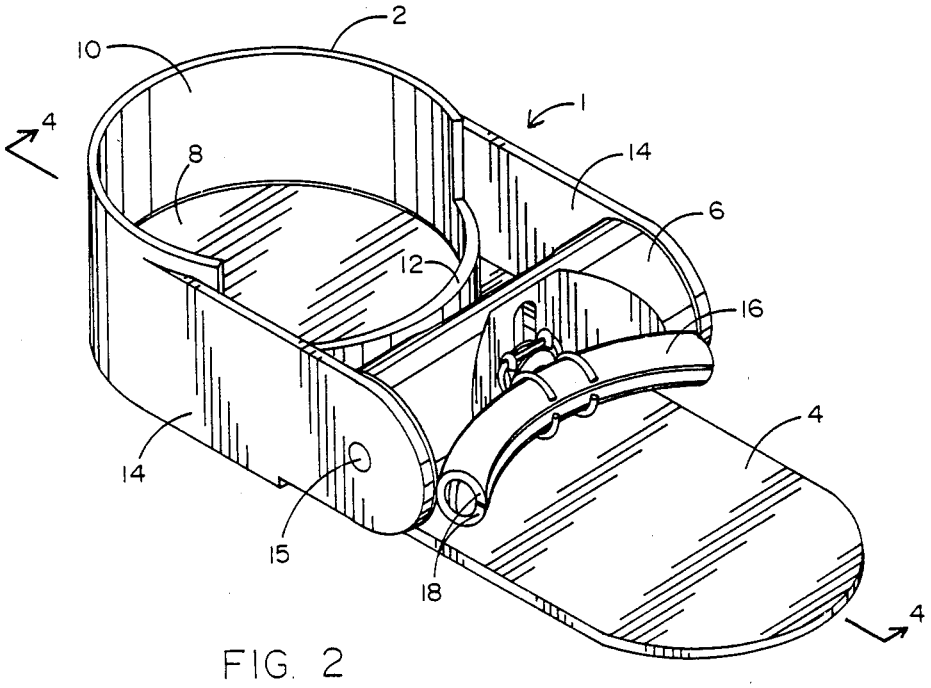
FIG. 2 is an elevational view of the cup and plate holder of FIG. 1 with the platform rotated to an open position.
Figure 3:
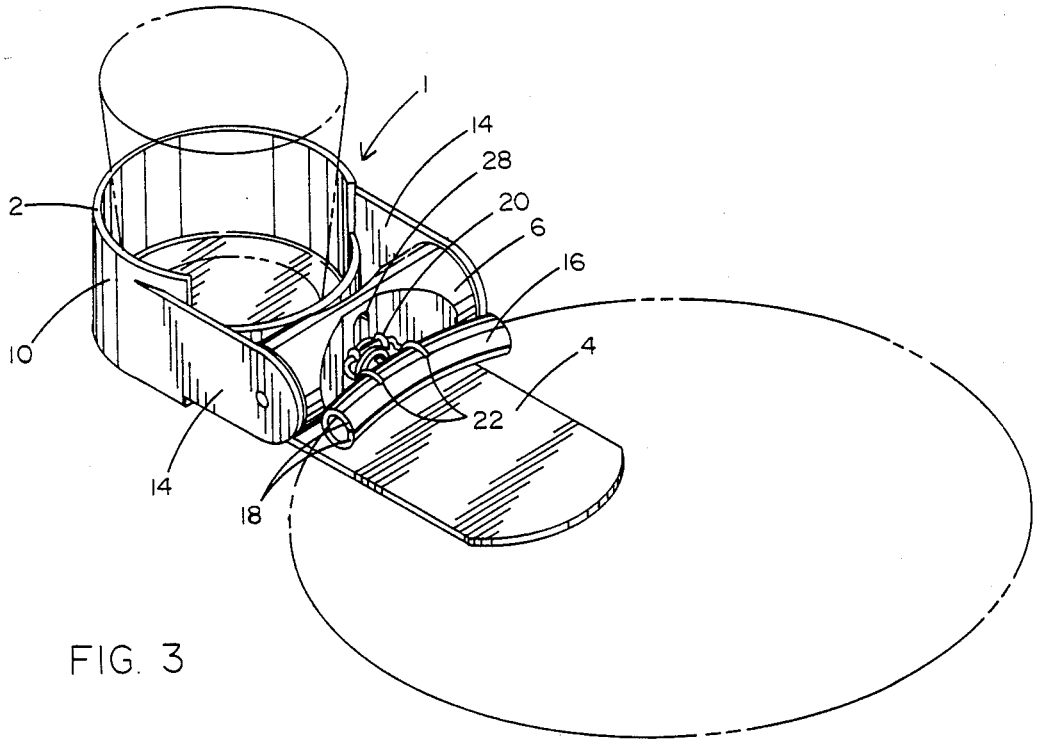
FIG. 3 is an elevational view of the cup and plate holder of FIG. 1 being in receipt of a glass and a plate.

The combination cup and plate holder which forms the present invention is now described while referring concurrently to FIGS. 1 and 2 of the drawings. The cup and plate holder 1 comprises a retaining collar 2 in which to receive a cup or glass (as is best illustrated in FIG. 3), a rotatable platform 4 on which to receive a plate (also best illustrated in FIG. 3), and a rotatable support block 6 connected to the platform 4 so as to control the rotation thereof. Each of the collar 2, platform 4 and support block 6 is preferably formed from a lightweight material, such as plastic, compressed paper, or the like, although the particular material used in the manufacture of holder 1 forms no part of the present invention.

The retaining collar 2 includes a flat bottom 8 and a hollow cylindrical body 10 coextensively connected thereto. A frontal section 12 of the cylindrical body 10 of collar 2 is removed so that the platform may be rotated in a counter-clockwise direction towards and received within collar 2 (best illustrated in FIG. 1). A pair of side arms 14 extend between opposite sides of the collar body 10 and respective ends of the support block 6. By way of example, first ends of the side arms 14 may be glued to the body 10 of collar 2. Opposite ends of the side arms 14 may be connected to respective ends of the support block 6 by retaining pins 15, or the like, such as rivets or screws. The support block 6 is supported between side arms 14 and rotatable around an axis which is defined by the retaining pins 15. Although the collar 2 and side arms 14 have been described as being separate elements, it is to be understood that such elements may be molded or otherwise formed, as one integral part of cup and plate holder 1.

The platform 4 is preferably a tongue-shaped, flat member having a linear dimension which is sufficient to permit a plate and its contents to be supported thereon. A first end of platform 4 projects outwardly from the support block 6 for receipt of a plate (best shown in FIG. 3). The opposite end of platform 4 is connected, by means of screws, or the like, to the support block 6. By virtue of its connection to support block 6, the platform 4 is adapted to rotate with the support block 6 between open and closed positions.

More particularly, and as is best illustrated in FIG. 2, platform 4 may be rotated in a clockwise direction along with support block 6 to the open position so as to extend away from the retaining collar 2 and, thereby be in a suitable position to receive a plate thereon. Or, as is best illustrated in FIG. 1, the platform 4 may be rotated towards retaining collar 2 and in a counter-clockwise direction along with support block 6 from the open position (shown in phantom) to the closed position. In the closed position, the platform 4 extends through the frontal section 12 of the collar 2 to be received within the hollow cylindrical body 10 thereof. Accordingly, the cup and plate holder 1 may, in the closed position, be conveniently reduced in size to a compact arrangement which is suitable for transport and/or storage upon a shelf or in a lady's handbag.

Figure 4:
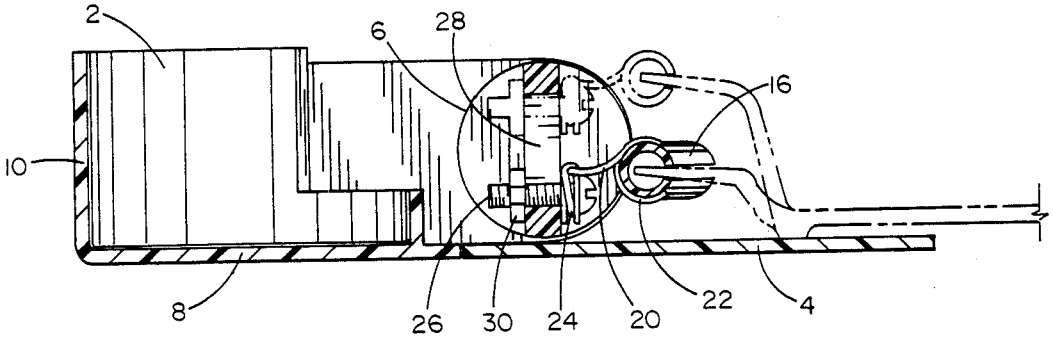
FIG. 4 is a cross-section taken along lines 4—4 of FIG. 2.

Cup and plate holder 1 is also provided with an adjustable clamp 16 which projects outwardly from the support block 6 above the platform 4 so as to retain a plate or similar article (shown in phantom in FIGS. 3 and 4) upon the platform. As is best shown in FIGS. 3 and 4, clamp 16 includes a pair of oppositely disposed jaws 18 between which the lip or rim of a plate or bowl is releasably received. The clamp 16 may be fabricated from a resilient material, such as plastic, or a non-resilient material, such as metal. However, regardless of the material selected, it is desirable that the jaws 18 of clamp 16 be provided with a spring-like memory and be biased in a normally closed position (as shown) for detachably engaging the lip of the plate (or bowl) which is to be supported upon the platform 4.

A clip 20 is provided by which to connect the clamp 16 to the support block 6, so that clamp 16 is rotatable with support block 6 and platform 4 between the closed and opened positions (of FIGS. 1 and 2). By way of example, the clip 20 includes a pair of arms 22 which are affixed at first ends thereof to the jaws 18 of clamp 16, so as to bias said jaws in the normally closed position. The opposite ends of arms 22 are connected to a circular base 24. The circular base 24 is sized to receive therethrough a conventional fastener, such as a bolt 26. A vertical slot 28 is formed through the support block 6, and the bolt 26 is first inserted into the circular base 24 of clip 20 and then through the slot 28 of support block 6. A nut 30 is mated to the bolt 26, whereby to tighten down the base 24 of clip 20 against the face of support block 6, so that clamp 16 is properly aligned to receive the lip of a plate (or bowl) between the jaws thereof.

The user may slide the clip 20 along the vertical slot 28 in support block 6 after loosening the bolt 26 and nut 30 from support block 6. In this manner, and as is best illustrated in FIG. 4 of the drawings, the location of the clamp 16 may be selectively adjusted above the platform 4, so as to reliably retain plates and bowls of different sizes (shown in phantom) upon the platform. Hence, the cup and plate holder 1 of the present invention is advantageously adapted to releasably engage a variety of plate configurations without requiring a structural modification to or replacement of the clamp 16 or support block 6 to which such clamp is connected.

It will be apparent that while a preferred embodiment of the invention has been shown and described, various modifications additions may be made without departing from the true scope and spirit of the invention.

Having thus set forth a preferred embodiment of the invention, what is claimed is:

1. A combination cup and plate holder having a supporting frame and comprising:

means located at one end of said supporting frame for receiving a cup;

means located at the opposite end of said supporting frame for receiving a plate; and means interconnected with said plate receiving means for rotating said plate receiving means between an open position projecting in a direction away from said cup receiving means for receiving a plate thereon and a closed position extending over the top of said cup receiving means for forming a compact arrangement.

2. The cup and plate holder recited in claim 1, wherein said means for receiving a cup includes a hollow, cylindrical retaining collar.

3. The cup and plate holder recited in claim 2, wherein a portion of said cylindrical retaining collar is removed to accommodate said plate receiving means therethrough when said plate receiving is rotated to the closed position atop said cup receiving means.

4. The cup and plate holder recited in claim 1, wherein said means for receiving a plate includes a flat platform for supporting said plate thereon.

5. The cup and plate holder recited in claim 1, wherein the means to rotate said plate receiving means includes a rotatable support connected to one end of said plate receiving means, such that a rotation of said plate receiving means between the open and closed positions causes a corresponding rotation of said rotatable support.

6. The cup and plate holder recited in claim 5, further comprising clamping means attached to said support, said clamping means releasably engaging a plate for retaining said plate upon said plate receiving means.

7. The cup and plate holder recited in claim 6, wherein said support has a slot extending therethrough, said clamping means being slideable through said slot for adjusting the location of said clamping means relative to said plate receiving means for engaging plates of different sizes.

8. The cup and plate holder recited in claim 1, further comprising clamping means by which to releasably engage a plate that is received by said plate receiving means for retaining said plate thereon.

9. The cup and plate holder recited in claim 8, wherein said clamping means includes a pair of opposing jaws between which said plate is received for retaining said plate upon said plate receiving means.

10. The cup and plate holder recited in claim 8, further comprising means by which to adjust the location of said clamping means relative to said plate receiving means to enable said clamping means to engage plates of different sizes.

11. A combination cup and plate holder having a supporting frame and comprising:

means located at one end of said supporting frame for receiving a cup;

means located at the opposite end of said supporting frame for receiving a plate;

clamping means by which to releasably engage a plate that is received by said plate receiving means for retaining said plate thereon; and means by which to adjust the location of said clamping means relative to said plate receiving means to enable said clamping means to engage plates of different sizes.

12. The cup and plate holder recited in claim 11, wherein said clamping means includes a pair of opposing jaws between which a plate is received for retaining said plate upon said plate receiving means.

13. The cup and plate holder recited in claim 11, further comprising means by which to rotate said plate receiving means between an open position projecting in a direction away from said cup receiving means for receiving a plate thereon and a closed position extending over the top of said cup receiving means for forming a compact arrangement.

14. The cup and plate holder recited in claim 13, wherein the means to rotate said plate receiving means includes a rotatable support connected to one end of said plate receiving means, such that a rotation of said plate receiving means between the open and closed positions causes a corresponding rotation of said rotatable support.

15. The cup and plate holder recited in claim 14, wherein said rotatable support has a slot extending therethrough, said clamping means being connected to said support and slideable through said slot for adjusting the location of said clamping means relative to said plate receiving means.

16. The cup and plate holder recited in claim 11, wherein said means for receiving a cup includes a hollow, cylindrical retaining collar.

17. The cup and plate holder recited in claim 11, wherein said means for receiving said plate is a flat platform, said clamping means being located above said platform for engaging a plate that is received thereon.

18. A combination cup and plate holder having a supporting frame and comprising:

hollow means located at one end of said supporting frame for receiving a cup;

flat platform means located at the opposite end of said supporting frame for receiving a plate;

clamping means by which to releasably engage a plate that is received by said platform means for retaining said plate thereon; and rotatable support means interconnected with said platform means for rotating said platform means between an open position projecting in a direction away from said cup receiving means for receiving a plate thereon and a closed position at a location within the hollow interior of said cup receiving means for forming a compact arrangement.

19. The cup and plate holder recited in claim 18, wherein said clamping means is connected to said rotatable support means and supported thereby above said platform means for engaging a plate that is received thereon.

20. The cup and plate holder recited in claim 18, wherein said cup receiving means has an opening formed through one side thereof, said plate receiving means extending through said opening for receipt at the location within the hollow interior of said cup receiving means when said plate receiving means is rotated to said closed position.

* * * * *